US012201143B2

(12) United States Patent
Beeson

(10) Patent No.: US 12,201,143 B2
(45) **Date of Patent: *Jan. 21, 2025**

(54) FLAVOR DELIVERY ARTICLE

(71) Applicant: R.J. Reynolds Tobacco Company, Winson-Salem, NC (US)

(72) Inventor: Dwayne William Beeson, Kernersville, NC (US)

(73) Assignee: R.J. REYNOLDS TOBACCO COMPANY, Winston-Salem, NC (US)

( * ) Notice: Subject to any disclaimer, the term of this patent is extended or adjusted under 35 U.S.C. 154(b) by 8 days.

This patent is subject to a terminal disclaimer.

(21) Appl. No.: 18/295,668

(22) Filed: Apr. 4, 2023

(65) Prior Publication Data

US 2023/0232895 A1 Jul. 27, 2023

Related U.S. Application Data

(63) Continuation of application No. 14/848,818, filed on Sep. 9, 2015, now Pat. No. 11,641,874.

(51) Int. Cl.

| | |
|---|---|
| ***A24D 3/14*** | (2006.01) |
| ***A24B 15/16*** | (2020.01) |
| ***A24B 15/28*** | (2006.01) |
| ***A24D 1/00*** | (2020.01) |
| ***A24D 1/02*** | (2006.01) |
| ***A24D 3/04*** | (2006.01) |
| ***A24D 3/06*** | (2006.01) |
| ***A24D 3/17*** | (2020.01) |
| ***A24F 42/20*** | (2020.01) |

(52) U.S. Cl.

CPC ..... *A24D 3/14* (2013.01); *A24B 15/16* (2013.01); *A24B 15/283* (2013.01); *A24D 1/002* (2013.01); *A24D 1/02* (2013.01); *A24D 3/048* (2013.01); *A24D 3/061* (2013.01); *A24D 3/17* (2020.01); *A24F 42/20* (2020.01)

(58) Field of Classification Search

None

See application file for complete search history.

(56) References Cited

U.S. PATENT DOCUMENTS

| | | | |
|---|---|---|---|
| 3,972,335 | A | 8/1976 | Tiggelbeck et al. |
| 4,082,098 | A | 4/1978 | Owens, Jr. |
| 4,281,671 | A | 8/1981 | Byrne et al. |
| 4,729,391 | A | 3/1988 | Woods et al. |
| 4,862,905 | A | 9/1989 | Green, Jr. et al. |
| 4,941,486 | A | 7/1990 | Dube et al. |
| 5,012,829 | A | 5/1991 | Thesing et al. |

(Continued)

FOREIGN PATENT DOCUMENTS

| | | |
|---|---|---|
| CN | 104223366 | 12/2014 |
| CN | 104005253 | 5/2016 |

(Continued)

*Primary Examiner* — Phu H Nguyen

(74) *Attorney, Agent, or Firm* — WOMBLE BOND DICKINSON (US) LLP

(57) ABSTRACT

A flavor delivery article is provided including a substantially rod-shaped carrier element and a wrapping element. The wrapping element surrounds at least a portion of the carrier element. The delivery article includes a flavor material within one or both of the carrier element and the wrapping element. The flavor delivery article is adapted for delivery of the flavor material to the mouth of a user under mouth conditions in the absence of combustion or other external heating.

20 Claims, 3 Drawing Sheets

(56) References Cited

U.S. PATENT DOCUMENTS

| | | | |
|---|---|---|---|
| 5,133,368 | A | 7/1992 | Neumann et al. |
| 5,220,930 | A | 6/1993 | Gentry |
| 6,041,790 | A | 3/2000 | Smith et al. |
| 6,082,368 | A | 7/2000 | Brown |
| 6,584,979 | B2 | 7/2003 | Xue et al. |
| 7,275,548 | B2 | 10/2007 | Hancock et al. |
| 7,281,540 | B2 | 10/2007 | Barnes et al. |
| 2002/0162562 | A1 | 11/2002 | Williams |
| 2002/0162563 | A1 | 11/2002 | Williams |
| 2002/0166563 | A1 | 11/2002 | Jupe et al. |
| 2003/0070687 | A1 | 4/2003 | Atchley et al. |
| 2004/0020503 | A1 | 2/2004 | Williams |
| 2005/0066982 | A1 | 3/2005 | Clark et al. |
| 2005/0178398 | A1 | 8/2005 | Breslin et al. |
| 2006/0191548 | A1 | 8/2006 | Strickland et al. |
| 2007/0062549 | A1 | 3/2007 | Holton, Jr. et al. |
| 2007/0186941 | A1 | 8/2007 | Holton, Jr. et al. |
| 2007/0186942 | A1 | 8/2007 | Strickland et al. |
| 2007/0215167 | A1 | 9/2007 | Crooks et al. |
| 2008/0021072 | A1 | 1/2008 | Luzenberg |
| 2008/0029110 | A1 | 2/2008 | Dube et al. |
| 2008/0029116 | A1 | 2/2008 | Robinson et al. |
| 2008/0029117 | A1 | 2/2008 | Mua et al. |
| 2008/0173317 | A1 | 7/2008 | Robinson et al. |
| 2008/0209586 | A1 | 8/2008 | Nielsen et al. |
| 2009/0126746 | A1 | 5/2009 | Strickland et al. |
| 2009/0288671 | A1 | 11/2009 | White et al. |
| 2011/0271972 | A1 | 11/2011 | Thomas et al. |
| 2012/0125354 | A1 | 5/2012 | Byrd et al. |
| 2012/0192880 | A1 | 8/2012 | Dube et al. |
| 2013/0074856 | A1 | 3/2013 | Holton, Jr. |
| 2013/0112216 | A1 | 5/2013 | Clarke et al. |
| 2014/0366901 | A1 | 12/2014 | Shinozaki et al. |
| 2015/0237913 | A1 | 8/2015 | Suzuki et al. |

FOREIGN PATENT DOCUMENTS

| | | |
|---|---|---|
| CN | 104372719 | 5/2016 |
| CN | 104886766 | 5/2016 |
| WO | WO 2004/047572 | 6/2004 |
| WO | WO 2004/057986 | 7/2004 |
| WO | WO 2012/054111 | 4/2012 |
| WO | WO 2013/111320 | 5/2013 |
| WO | WO 2013/118299 | 8/2013 |
| WO | WO 2014/021310 | 2/2014 |
| WO | WO 2014/115324 | 7/2014 |
| WO | WO 2015/046385 | 4/2015 |
| WO | WO 2015/046386 | 4/2015 |
| WO | WO 2015/046387 | 4/2015 |
| WO | WO 2015/046420 | 4/2015 |
| WO | WO 2015/049793 | 4/2015 |
| WO | WO 2015/115417 | 8/2015 |

FLAVOR DELIVERY ARTICLE

REFERENCE TO RELATED APPLICATIONS

This application is a continuation of U.S. application Ser. No. 14/848,818, filed Sep. 9, 2015, the contents of which are incorporated herein by reference in its entirety.

FIELD OF THE DISCLOSURE

The present disclosure relates to flavor delivery articles intended for delivery of flavors for human consumption. The flavor may contain ingredients or components obtained or derived from plants of the *Nicotiana* species.

BACKGROUND

Popular smoking articles, such as cigarettes, have a substantially cylindrical rod shaped structure and include a charge, roll or column of smokable material such as shredded tobacco (e.g., in cut filler form) surrounded by a paper wrapper thereby forming a so-called "tobacco rod." Normally, a cigarette has a cylindrical filter element aligned in an end-to-end relationship with the tobacco rod. Typically, a filter element comprises plasticized cellulose acetate tow circumscribed by a paper material known as "plug wrap." Typically, the filter element is attached to one end of the tobacco rod using a circumscribing wrapping material known as "tipping paper." A cigarette is employed by a smoker by lighting one end thereof and burning the tobacco rod. The smoker then receives mainstream smoke into his/her mouth by drawing on the opposite end (e.g., the filter end) of the cigarette.

Tobacco also may be enjoyed in a so-called "smokeless" form. Particularly popular smokeless tobacco products are employed by inserting some form of processed tobacco into the mouth of the user. See for example, the types of smokeless tobacco formulations, ingredients, and processing methodologies set forth in U.S. Pat. No. 1,376,586 to Schwartz; U.S. Pat. No. 3,696,917 to Levi; U.S. Pat. No. 4,513,756 to Pittman et al.; U.S. Pat. No. 4,528,993 to Sensabaugh, Jr. et al.; U.S. Pat. No. 4,624,269 to Story et al.; U.S. Pat. No. 4,991,599 to Tibbetts; U.S. Pat. No. 4,987,907 to Townsend; U.S. Pat. No. 5,092,352 to Sprinkle, III et al,; U.S. Pat. No. 5,387,416 to White et al.; U.S. Pat. No. 6,668,839 to Williams; U.S. Pat. No. 6,834,654 to Williams; U.S. Pat. No. 6,953,040 to Atchley et al.; U.S. Pat. No. 7,032,601 to Atchley et al.; and U.S. Pat. No. 7,694,686 to Atchley et al.; US Pat. Pub. Nos. 2004/0020503 to Williams; 2005/0115580 to Quinter et al.; 2005/0244521 to Strickland et al.; 2006/0191548 to Strickland et al.; 2007/0062549 to Holton, Jr. et al.; 2007/0186941 to Holton, Jr. et al.; 2007/0186942 to Strickland et al.; 2008/0029110 to Dube et al.; 2008/0029116 to Robinson et al.; 2008/0029117 to Mua et al.; 2008/0173317 to Robinson et al.; 2008/0196730 to Engstrom et al.; 2008/0209586 to Neilsen et al.; 2008/0305216 to Crawford et al.; 2009/0065013 to Essen et al.; 2009/0293889 to Kumar et al.; and 2010/0291245 to Gao et al; PCT WO 04/095959 to Arnarp et al. and WO 2010/132444 A2 to Atchley; and U.S. patent application Ser. No. 12/638,394, filed Dec. 15, 2009, to Mua et al.; each of which is incorporated herein by reference.

Efforts for delivery of tobacco materials in the absence of significant combustion have also been pursued. So-called heat-not-burn products have included a cigarette with a heat element at the distal end thereof, such as a carbon element that is "lit" and then emits heat to release tobacco materials during draw on the opposing end of the cigarette. So called E-cigarettes have also been developed as alternatives to cigarettes and smokeless tobacco products. E-cigarettes rely on the use of a heating element to provide heat to a liquid flavor material. The flavor material is consumed when the heated flavor material is atomized and drawn into the mouth of the user. See, for example, the various electronic smoking articles, aerosol delivery devices and heat generating sources set forth in the background art described in U.S. Pat. No. 7,726,320 to Robinson et al. and U.S. patent application publication No. 2014/0096781, published Apr. 10, 2014, to Sears et al., which are incorporated herein by reference.

It would be desirable to provide a flavor delivery article that mimics the look and feel of a traditional cigarette in the hand of the user, but delivers the desired consumable flavor material without combustion or other external heating.

BRIEF SUMMARY

This disclosure provides a flavor delivery article that may be used to deliver tobacco extract or a tobacco derived nicotine extract as a preferred flavor material. The flavor delivery article may include a substantially rod-shaped carrier element and a wrapping element surrounding at least a portion of the carrier element. A flavor material can be included in one or both of the carrier element and the wrapping element. The flavor delivery article delivers the flavor material to the mouth of a user in the absence of combustion or other external heating. A user, holding the delivery article in their mouth, may release the flavor material, e.g. tobacco extract, for consumption thereof. For example, the flavor delivery article may use one or more of drawn air, body heat, moisture, and chewing to retrieve the flavor from the flavor delivery article.

In some embodiments, the carrier element may include filter material, as found in traditional cigarettes, in various forms to replace the volume of a tobacco rod. The wrapping element may include tipping paper and wrapping paper to surround the carrier element to maintain the look and feel of a traditional cigarette.

These and other aspects of the present disclosure will become apparent to those skilled in the art after a reading of the following description of the preferred embodiments, when considered in conjunction with the drawings. It should be understood that both the foregoing general description and the following detailed description are explanatory only and are not restrictive of the invention as claimed.

BRIEF DESCRIPTION OF THE DRAWINGS

In order to provide an understanding of embodiments of the invention, reference is made to the appended drawings, which are not necessarily drawn to scale, and in which reference numerals refer to components of exemplary embodiments of the invention. The drawings are exemplary only, and should not be construed as limiting the invention.

DETAILED DESCRIPTION

The present invention now will be described more fully hereinafter. This invention may, however, be embodied in many different forms and should not be construed as limited to the embodiments set forth herein; rather, these embodiments are provided so that this disclosure will be thorough and complete, and will fully convey the scope of the invention to those skilled in the art. As used in this specification and the claims, the singular forms "a," "an," and "the" include plural referents unless the context clearly dictates otherwise. Reference to "dry weight percent" or "dry weight basis" refers to weight on the basis of dry ingredients (i.e., all ingredients except water).

Figure 1:
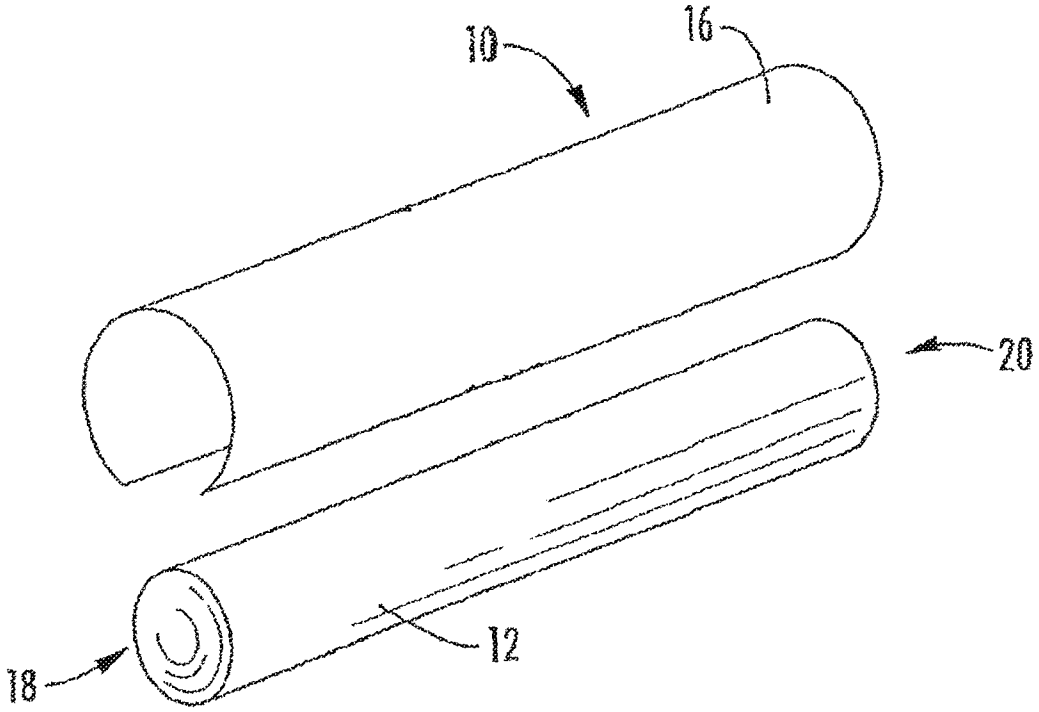
FIG. 1 is an exploded perspective view of a flavor delivery article according to embodiments of the present invention.

Referring to FIG. 1, there is shown a flavor delivery article 10 configured to provide the look and feel of a traditional cigarette. As an alternative to flavor delivery via combustion of a tobacco material, such as in a traditional cigarette, in relation to the presently described articles, a user can simply hold the article 10 in their mouth to release consumable flavor materials and optional buffers held within the delivery article for consumption based on mouth conditions. Additionally or alternatively, the flavor material may be released by drawing air through the article. Use of mouth conditions is intended to allow the flavor material to be consumed by the user without the requirement of combustion (such as required with a traditional cigarette) and without the requirement of an external heat source (such as required with E-cigarettes and heat-not-burn articles). As such, the present flavor delivery article may be characterized in relation to being adapted for delivery of the flavor material to the mouth of a user in the absence of combustion or other external heating. Accordingly, "external heating" can mean any heating by any source other than body heat (particularly mouth heat). External heating can particularly mean an electrical heater, a flame, a heat sink, or a chemical heating element.

Mouth conditions can encompass one or more characteristics (in any combination) associated with the presence of an item in the mouth of a user. For example, mouth conditions can include any combination of temperature, moisture, and pH typically found in the mouth of a human as well as the shear, compression, and other mechanical forces that may be applied by the teeth during chewing. Mouth conditions particularly can relate to being in contact with saliva. For example, saliva in the mouth may at least partially solubilize a releasable component so that the component is freed from the composition for potential movement through the flavor delivery article and into the mouth of the user. Mouth conditions can include conditions wherein a releasable component is solubilized in a solvent so as to be mobilized from the composition for free movement via the solvent.

The article 10 includes a generally cylindrical flavor carrier 12 contained in a circumscribing wrapping element 16. The flavor carrier 12 provides a volume in place of a smokable "tobacco rod" of a conventional cigarette. The flavor carrier 12 may be a porous material to allow air to be drawn through the carrier 12 by a user.

One end of the article 10 may be referred to as an intake end 18. A mouth end 20 is defined opposite to the intake end 18. The intake end 18 and the mouth end 20 are defined to assist with the orientation of elements of the present disclosure. The mouth end 20 may be considered the end generally placed within the mouth of the user. However, unlike a traditional cigarette, it is more likely that the flavor delivery article 10 can be reversible, with the intake end 18 placed into the user's mouth. Selective placement of each end 18, 20 in the mouth may allow more flavor to be drawn from the article 10. In some embodiments, each end can provide a different flavor.

Figure 2:
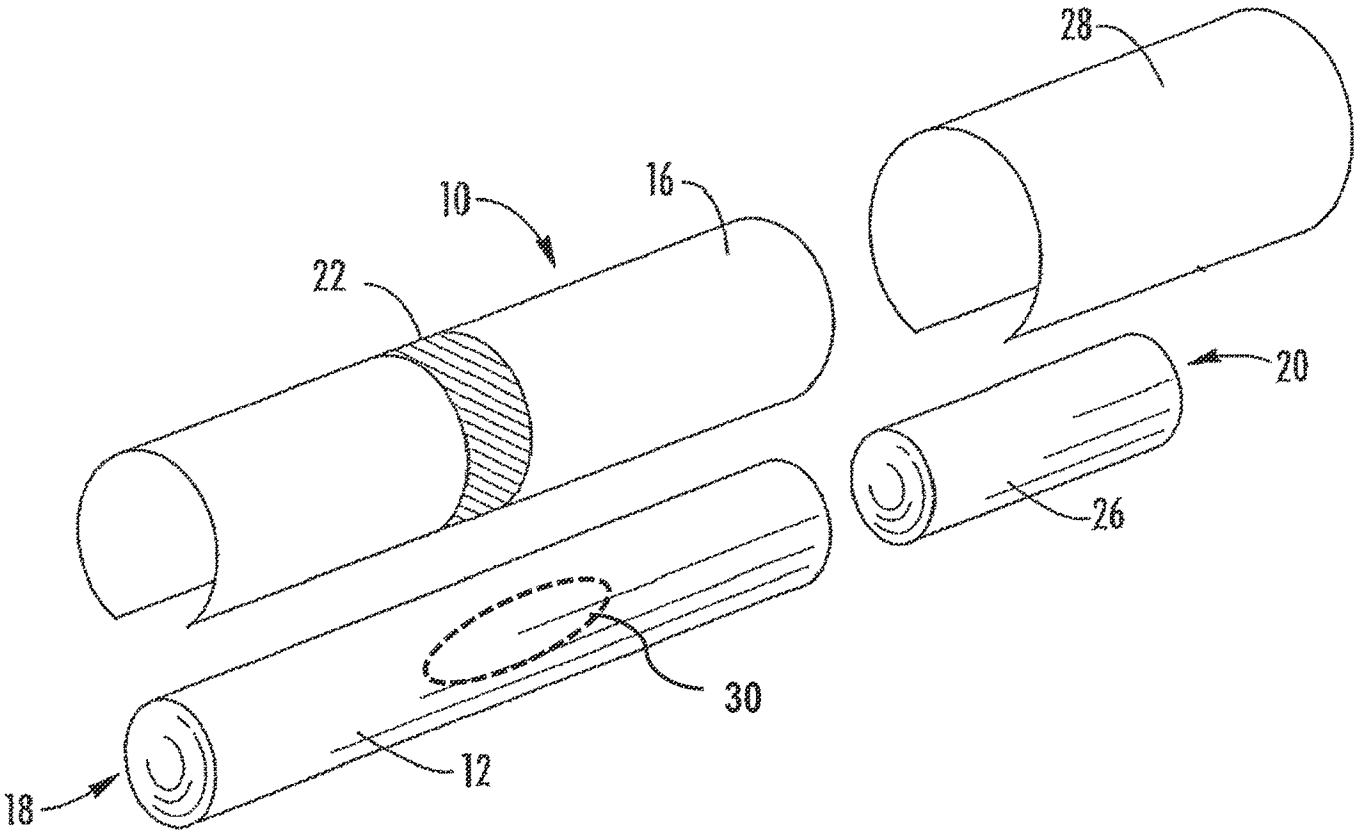
FIG. 2 is an exploded perspective view of another flavor delivery article according to other embodiments of the present invention.

FIG. 2 shows a second embodiment of the flavor delivery article 10. A filter element 26 may be positioned adjacent one end of the flavor carrier 12 such that the filter element and the flavor carrier are axially aligned in an end-to-end relationship, preferably abutting one another. Filter element 26 may have a generally cylindrical shape, and the diameter thereof may be essentially equal to the diameter of the flavor carrier 12. The ends of the filter element 26 permit the passage of air therethrough. The filter element 26 may be formed from the same material or a different material than the flavor carrier 12. The filter element 26 may have flavor therein as well, such that the filter element is a second flavor carrier. Therefore it should be understood that the length of the flavor delivery article 10 may comprise any number of separate flavor carriers, not just a single carrier shown in FIG. 1 or the pair of effective carriers shown in FIG. 2. Further it should be understood that the term "flavor carrier" relates to the cylindrical bodies capable of carrying flavor for consumption, even though flavor may not be added to a particular flavor carrier in embodiments with multiple flavor carriers or embodiments where flavor is provided in the wrapping element. A tipping material 28 may enwrap the filter element 26 and a portion of the wrapping element 16 of the flavor carrier 12, thereby securing the flavor carrier to the filter element 26. The tipping material 28 may be the same material or different material than the wrapping element 16. Where the same material is used, the tipping material 28 may be considered as part of the wrapping element 16. In some embodiments only the wrapping element 16 or the tipping material 28 may be present and may be extended in length to substantially cover and enwrap both the flavor carrier 12 and the filter element 16.

Figure 3:
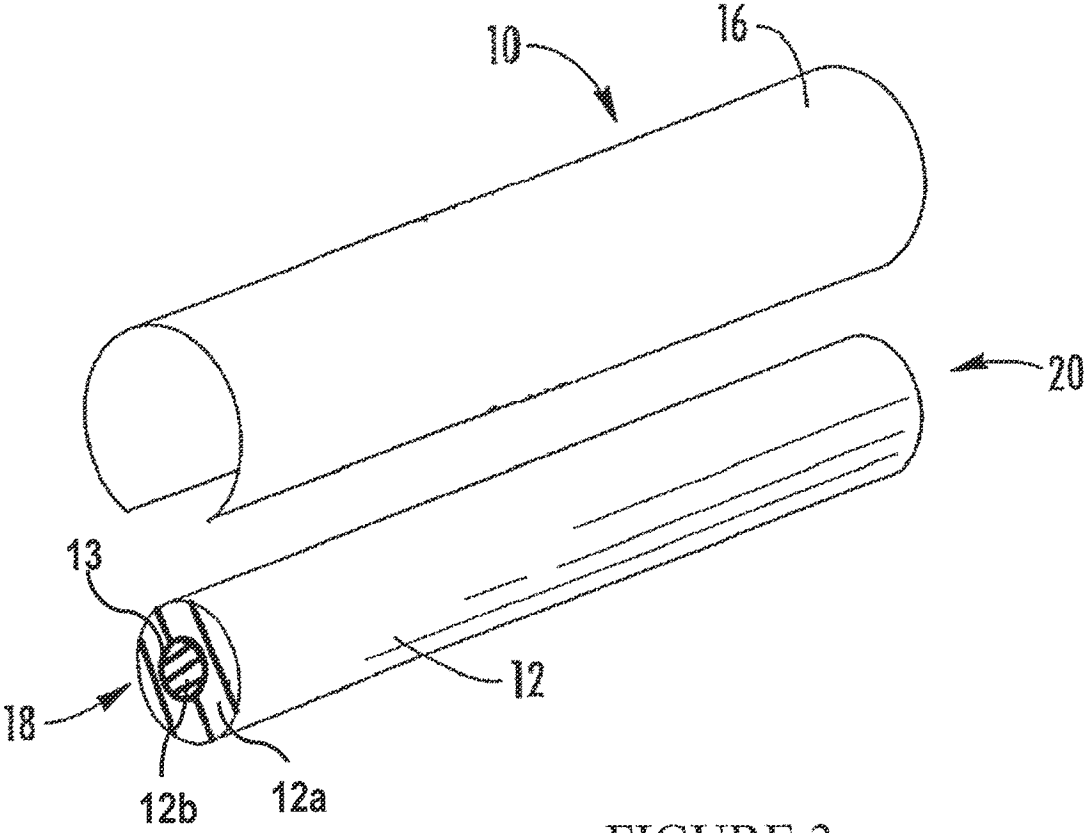
FIG. 3 is an exploded perspective vie of another flavor delivery article according to other embodiments of the present invention.

FIG. 3 shows a third embodiment of the flavor delivery article 10 with another arrangement of flavor carriers 12. FIG. 3 shows a hollow first flavor carrier 12*a*, producing a tube shaped carrier. A second flavor carrier 12*b* may be inserted into the interior of the hollow first flavor carrier 12*a*, or the second flavor carrier 12*b* may be otherwise encircled by the first flavor carrier 12*a*. In some embodiments, a barrier material 13 may be disposed between the concentric flavor carriers to avoid any undesired mixing between the layers of carrier. It should be understood that additional hollow flavor carriers can surround the first flavor carrier 12*a*. Similar to other embodiments, a wrapping element 16 may encircle the carriers 12 to form the outer layer of the flavor delivery article 10.

At least one of the tipping material 28, wrapping element 16, filter element 26 and flavor carrier 12 is modified, treated, constructed, combined, or otherwise provided with a flavor material that is capable of being released to and consumed by the user. In preferred embodiments, the flavor material includes at least a tobacco extract or tobacco derived nicotine extract.

Flavor material can be added to several components of the flavor delivery article 10. Each component can include different flavorings or flavor profiles. The flavorings can be provided to allow for sustained release through the use of techniques such as microencapsulation. The flavor materials can be provided to allow for selective release through techniques such as the use of breakable capsules within the carrier element 12. In many embodiments, combinations of different organoleptic properties can be provided within the same article 10 using a plurality of flavor materials.

In some embodiments, acid, such as levulinic acid, or other buffer ingredients may be added. These ingredients may be added for the purpose of soothing throat irritation that may develop during use of the product. The acid may also be added to any one or more of the flavor carrier 12, the filter element 26, the wrapping element 16 or the tipping material 28.

In some embodiments, the flavor delivery article 10 uses tobacco extract to replace the characteristics of dried, shredded tobacco. The flavor delivery article 10 of the present disclosure uses one or more flavor carriers 12 as a substitute for the physical volume of replaced tobacco in a traditional cigarette. Then, by using tipping materials and wrapping elements common to cigarettes, the flavor delivery article 10 of the present disclosure are able to provide the look and feel of a traditional cigarette to the user.

Again, the flavor carrier 12 may extend the full length of the flavor delivery article 10 as seen in FIG. 1, or the carrier may be positioned at the intake end 18 of the article and generally abut the end of a second flavor carrier, for example a filter element 26, to provide the substantially filled volume of the cylindrical flavor delivery article. The filter element 26, if present, and the flavor carrier 12 may be made from traditional filter material used in cigarettes.

The filter material can vary, and can be any material of the type that can be employed for providing a filter for cigarettes. Preferably a traditional cigarette filter material is used, such as cellulose acetate tow, gathered cellulose acetate web, polypropylene tow, gathered cellulose acetate web, gathered paper, or the like. Especially preferred is filamentary tow such as cellulose acetate, polyolefins such as polypropylene, or the like. One preferred filter material that can provide a suitable filter element is cellulose acetate tow having 3 denier per filament and 40,000 total denier. As another example, cellulose acetate tow having 3 denier per filament and 35,000 total denier can provide a suitable filter element. As another example, cellulose acetate tow having 8 denier per filament and 40,000 total denier can provide a suitable filter element. For further examples, see the types of filter materials set forth in U.S. Pat. No. 3,424,172 to Neurath; U.S. Pat. No. 4,811,745 to Cohen et al.; U.S. Pat. No. 4,925,602 to Hill et al.; U.S. Pat. No. 5,225,277 to Takegawa et al. and U.S. Pat. No. 5,271,419 to Arzonico et al.

The filter material may also comprise other highly porous fibers, tows, films, pellets, threads, or non-woven materials such as, for example, rayon, polyester, or polypropylene, in addition to or instead of cellulose acetate. Where provided, the highly porous fibers may be configured to collect and retain a liquid flavor material, such as tobacco extract.

As understood from the disclosures above, the flavor carriers 12 of this disclosure may be used to hold and selectively release flavor materials, such as tobacco extract, for consumption by the user. The flavor material may be added in various forms such as liquids, powders, pellets, or capsules as discussed further below.

The use of filter elements as vehicles for adding flavor to cigarettes can be seen in various forms. U.S. Pat. Appl. Pub. No. 2002/0166563 to Jupe et al. proposes the placement of adsorbent and flavor-releasing materials in a cigarette filter. U.S. Pat. No. 6,584,979 to Xue et al. proposes the placement of fibers containing small particle size adsorbents/absorbents in the filter. U.S. Pat. No. 4,941,486 to Dube et al. and U.S. Pat. No. 4,862,905 to Green, Jr. et al. propose the placement of a flavor-containing pellet in a cigarette filter. Other representative types of cigarette filters incorporating flavoring agents are set forth in U.S. Pat. No. 3,972,335 to Tiggelbeck et al.; U.S. Pat. No. 4,082,098 to Owens, Jr.; U.S. Pat. No. 4,281,671 to Byrne; U.S. Pat. No. 4,729,391 to Woods et al.; and U.S. Pat. No. 5,012,829 to Thesing et al.

Representative types of carriers incorporating objects, and representative types of cigarettes possessing incorporated flavor objects, such as flavor-containing capsules or pellets, can possess the types of components, format and configuration, and can be manufactured using the types of techniques and equipment set forth in U.S. Patent Application Publication No. 2008/0029118 A1 to Nelson et al.; and U.S. Pat. No. 7,115,085 to Deal, U.S. Pat. No. 4,862,905 to Green, Jr. et al., and U.S. Pat. No. 7,479,098 to Thomas et al.; which are incorporated herein by reference in their entireties.

The wrapping element 16 of the flavor delivery article 10 can have a wide range of compositions and properties. The selection of a particular material for the wrapping element will be readily apparent to those skilled in the art of cigarette design and manufacture. The article 10 can have one layer of wrapping material: or they can have more than one layer of circumscribing wrapping material that forms the wrapping element. Exemplary types of wrapping materials, wrapping material components and treated wrapping materials are described in U.S. Pat. No. 5,220,930 to Gentry; U.S. Pat. No. 7,275,548 to Hancock et al.; and U.S. Pat. No. 7,281,540 to Barnes et al.; and PCT Application Pub. No. WO 2004/057986 to Hancock et al.; and PCT Application Pub. No. WO 2004/047572 to Ashcraft et al., which are incorporated herein by reference in their entireties.

Tipping material may form all or some of the wrapping element 16. Tipping material that is used to surround the filter element or flavor carrier, in the form of one or more layers, can vary. In certain preferred embodiments, the material used to construct tipping material layers has the characteristics and qualities commonly associated with cigarette tipping materials known in the art. As such, the layers can be constructed of the types of material conventionally used as tipping material in the manufacture of cigarettes. Typical tipping materials are papers exhibiting relatively high opacities. Representative tipping materials have TAPPI opacities of greater than about 81 percent, often in the range of about 84 percent to about 90 percent, and sometimes greater than about 90 percent. Typical tipping materials are printed with inks, typically nitrocellulose based, which can provide for a wide variety of appearances and "lip release" properties. Representative tipping papers have basis weights ranging from about 25 $m/m^2$ to about 60 $g/m^2$, often about 30 $m/m^2$ to about 40 $g/m^2$. Representative tipping papers are available as Tervakoski Reference Nos. 3121, 3124, TK 652, TK674, TK675, A360 and A362; and Schweitzer-Mauduit International Reference Nos. GSR270 and GSR265M2. See also, for example, the types of tipping materials, the methods for combining cigarette components using tipping materials, and techniques for wrapping various portions of cigarettes using tipping materials, that are set forth in U.S. patent application Ser. No. 11/377,630, filed Mar. 16, 2006, to Crooks et al.

Adhesives used to secure tipping materials to each other or to other components can vary. Typical exemplary adhesive formulations that are used for application of tipping material to other components in commercial filtered cigarette manufacturing operations are water-based emulsions incorporating mixtures of ethylene vinyl acetate copolymers and polyvinyl acetate. Representative adhesives that are useful for applying tipping materials to cigarette components are available as Reference Nos. 32-2049 and 32-2124 from National Starch & Adhesives Corp. See also, for example, Skeist, Handbook of Adhesives, $2^{nd}$ Edition (1977); Schneberger, Adhesive in Manufacturing (1983); Gutcho, Adhesives Technology Developments Since 1979

(1983); Landrock, Adhesives Technology Handbook (1985); and Flick, Handbook of Adhesives Raw Materials, 2nd Edition (1989).

In some embodiments, a plurality of materials can be used to create a plurality of layers for the wrapping element. See U.S. Pat. No. 7,789,089, Dube et al. The first tipping material can be selected so as to exhibit one type of aroma or flavor sensation, and the second tipping material, which can be removable from the article, can be selected so as to exhibit another type of aroma or flavor sensation. In one aspect, the amount of aromatic or flavor material carried by one of the tipping materials can differ from that amount carried by the other. Thus, for example, an outer tipping material carrying a relatively low level of aromatic or flavor material can provide one type of sensation; while an inner tipping material carrying a relatively high level of aromatic or flavor material can, when the outer tipping material is removed from the flavor delivery article, provide impact in terms of the delivery of that aromatic or flavor material to the lips and mouth of the user. In certain embodiments, the outer tipping material can be adapted to prevent flavor materials incorporated in between the tipping materials or within the inner tipping material from escaping prior to use of the article, or can be adapted to mask the flavor prior to article use. At the time of use, the user can remove the outer layer to expose the flavor.

In some embodiments, releasable flavor materials that are provided in encapsulated form can be incorporated into either or both of the first and second tipping materials. For example, microcapsules can be positioned in the region between the layers of tipping material; and such flavor materials can be released by application of pressure or peeling of the outer tipping material from the inner tipping material.

In many embodiments the flavor material carried by the flavor delivery article 10 is a tobacco extract or similar flavor being derived from, but not itself including, dried shredded tobacco leaves. Tobacco extract or a similar extract from another *Nicotiana* species can be provided within the flavor delivery article 10 to provide the user with a suitable substitute for cigarettes or smokeless tobacco products, but exclude dried, shredded tobacco leaves typically found in those other products.

The extract selected for use in the flavor delivery article 10 can be derived from a variety of species, using a variety of techniques that produce extract in a variety of usable forms. The extract may be provided in a liquid form absorbed within one or more of the components discussed above. The extract may be provided in a substantially solid pellet-form suspended or otherwise held by one or more of the article's components. The extract may also be microencapsulated or selectively released from a breakable capsule.

The *Nicotiana* species used to derive the extract can be selected for the content of various compounds that are present therein. For example, where tobacco extracts are employed in the articles of the present disclosure, plants can be selected on the basis that those plants produce relatively high quantities of one or more of the compounds desired to be isolated therefrom. In certain embodiments, plants of the *Nicotiana* species (e.g., Galpao common tobacco) are specifically grown for their abundance of leaf surface compounds. Tobacco plants can be grown in greenhouses, growth chambers, or outdoors in fields, or grown hydroponically.

As used herein, the term "tobacco extract" means components separated from, removed from, or derived from, tobacco using tobacco extraction processing conditions and techniques. Purified extracts of tobacco or other botanicals specifically can be used. Typically, tobacco extracts are obtained using solvents, such as solvents having an aqueous nature (e.g., water) or organic solvents (e.g., alcohols, such as ethanol or alkanes, such as hexane). As such, extracted tobacco components are removed from tobacco and separated from the unextracted tobacco components; and for extracted tobacco components that are present within a solvent, (i) the solvent can be removed from the extracted tobacco components, or (ii) the mixture of extracted tobacco components and solvent can be used as such. Exemplary types of tobacco extracts, tobacco essences, solvents, tobacco extraction processing conditions and techniques, and tobacco extract collection and isolation procedures, are set forth in Australia Pat. No. 276,250 to Schachner; U.S. Pat. No. 2,805,669 to Meriro; U.S. Pat. No. 3,316,919 to Green et al.; U.S. Pat. No. 3,398,754 to Tughan; U.S. Pat. No. 3,424,171 to Rooker; U.S. Pat. No. 3,476,118 to Luttich; U.S. Pat. No. 4,150,677 to Osborne; U.S. Pat. No. 4,131,117 to Kite; U.S. Pat. No. 4,506,682 to Muller; U.S. Pat. No. 4,986,286 to Roberts et al.; U.S. Pat. No. 5,005,593 to Fagg; U.S. Pat. No. 5,065,775 to Fagg; U.S. Pat. No. 5,060,669 to White et al.; U.S. Pat. No. 5,074,319 to White et al.; U.S. Pat. No. 5,099,862 to White et al.; U S. Pat. No. 5,121,757 to White et al.; U.S. Pat. No. 5,131,415 to Munoz et al.; U.S. Pat. No. 5,230,354 to Smith et al.; U.S. Pat. No. 5,235,992 to Sensabaugh; U.S. Pat. No. 5,243,999 to Smith; U.S. Pat. No. 5,301,694 to Raymond; U.S. Pat. No. 5,318,050 to Gonzalez-Parra et al.; U.S. Pat. No. 5,435,325 to Clapp et al.; and U.S. Pat. No. 5,445,169 to Brinkley et al.; the disclosures of which are incorporated herein by reference in their entireties.

In some embodiments the flavor delivery article 10 contains flavor material that does not include tobacco extract or equivalent. In some other embodiments, the flavor delivery article 10 contains multiple flavor materials instead of or including tobacco extract. The flavor material may also be referred to as a "flavor", "flavorant", "flavoring", or "flavoring agent". Each term describes any flavorful or aromatic substance capable of altering the sensory characteristics associated with the flavor delivery article 10 and at least partially available for consumption by the user. Exemplary sensory characteristics that can be modified by the flavor material include, taste, mouth feel, moistness, coolness/heat, and/or fragrance/aroma.

The flavor materials can be provided from sources other than tobacco, can be natural or synthetic, and the character of these flavors can be described as, without limitation, fresh, sweet, herbal, confectionary, floral, fruity or spice. Such flavoring agents can be employed as concentrates or flavor packages. Specific types of flavors include, but are not limited to, vanilla, coffee, tea, chocolate, cream, mint, spearmint, menthol, peppermint, wintergreen, lavender, cardamom, nutmeg, cinnamon, dove, cascarilla, sandalwood, honey, maple, jasmine, ginger, anise, sage, licorice, lemon, orange, apple, peach, lime, cherry, and strawberry. Flavorants utilized in disclosed products also can include components that are considered moistening, cooling or smoothening agents, such as eucalyptus. These flavors may be provided neat (i.e., alone) or in a composite (e.g., spearmint and menthol or orange and cinnamon). In some instances, the flavorant may be provided in a spray-dried form.

Sweeteners can be used in natural or artificial form or as a combination of artificial and natural sweeteners. In one embodiment, syrup (e.g. corn syrup), sucralose, sucrose, or a combination thereof is the primary sweetener ingredient.

When present, a representative amount of sweetener, whether an artificial sweetener and/or natural sugar, may make up at least about 0.2 percent, at least about 1 percent, or at least about 5 percent, of the total dry weight of the composition. Preferably, the amount of sweetener within the composition will not exceed about 40 percent, often will not exceed about 35 percent, and frequently will not exceed about 30 percent, of the total dry weight of the composition.

For other examples of flavoring materials that may be suitable for the products disclosed, see, for example, US Pat. Appl. Pub. Nos. 2002/0162562 to Williams; 2002/0162563 to Williams; 2003/0070687 to Atchley et al.; 2004/0020503 to Williams, 2005/0178398 to Breslin et al.; 2006/0191548 to Strickland et al.; 2007/0062549 to Holton, Jr. et al.: 2007/0186941 to Holton, Jr. et al.; 2007/0186942 to Strickland et al.; 2008/0029110 to Dube et al.; 2008/0029116 to Robinson et al.; 2008/0029117 to Mua et al.; 2008/0173317 to Robinson et al.; and 2008/0209586 to Neilsen et al., each of which is incorporated herein by reference.

The flavor materials of the present disclosure can be combined with at least one of the wrapping element 16, tipping material 28, filter element 28 and flavor carriers 12 of the presently disclosed flavor delivery article 10 in the form of a powder. Suitable powders and methods of forming the powders are discussed in U.S. Pat. Pub. 2012/0192880 to Dube et al, the contents of which are incorporated herein in their entirety. There are various methods by which the powders may be incorporated into the present products. For example, extracts may be applied by way of a liquid formulation that may comprise both soluble and dispersible components. For exemplary means by which extracts may be incorporated into the present product, see, for example, U.S. Pat. No. 3,419,015 to Wochnowski; U.S. Pat. No. 4,054,145 to Berndt et al., U.S. Pat. No. 4,449,541 to Mays et al.; U.S. Pat. No. 4,819,668 to Shelar et al.; U.S. Pat. No. 4,850,749 to Sweeney; U.S. Pat. No. 4,887,619 to Burcham et al.; U.S. Pat. No. 5,022,416 to Watson; U.S. Pat. No. 5,103,842 to Strang et al.; U.S. Pat. No. 5,383,479 to Winterson et al.; and U.S. Pat. No. 5,711,320 to Martin and UK Patent No. 2075375 to Hauni, which are incorporated herein by reference.

The amount of powder incorporated within the flavor delivery article 10 can depend on the desired function of the powder, and the chemical makeup of the powder. The amount of powder added to the flavor delivery article 10 can vary.

In some embodiments, the flavor materials and/or buffering agents (discussed below) used in the flavor delivery article 10 are provided in a rnicroencapsulated form. The microencapsulated form may be used for all, some, or none of the flavor materials for any individual article 10. The microencapsulated form may be used in connection will all, some, or none of the flavor carrier 12, filter element 26, wrapping element 16, or tipping material 28 of each article 10.

The encapsulated form may include a wall or barrier structure defining an inner region or payload that contains the flavor material (i.e. additive). Use of additives in microencapsulated form can improve storage stability of the product, particularly the stability of the sensory profile of the product, and protect certain additives from degradation over time. Microencapsulation can also insulate the user from undesirable sensory characteristics associated with the encapsulated ingredient, such as certain fillers, or provide a milder sensory experience by extending the release of certain flavorants over time. Microencapsulation of water can allow the product to be produced, stored, and transported at a lower moisture level, which can reduce storage and transportation costs and improve storage stability of the product.

A representative microcapsule embodiment has an outer cover, shell, or coating that envelopes a liquid or solid core region, and in certain embodiments, the microcapsule can have a generally spherical shape. By encapsulating an additive within the core region of a microcapsule, the ability of the additive to interact with other components of the product is reduced or eliminated, which can enhance the storage stability of the resulting product. The core region, which typically releases the additive when the outer shell undergoes some type of physical destruction, breakage, or other loss of physical integrity (e.g., through dispersion, softening, crushing, application of pressure, or the like), thereby provides for altering the sensory properties of the smokeless tobacco product. Thus, in many embodiments, the outer shell of the microcapsules is designed to rupture during use or is water soluble under conditions of normal use.

The relative amounts of the various flavoring materials within the flavor delivery article, including the amount of the flavoring within the core region of the microcapsules, may vary.

Exemplary manners and methods for providing encapsulated materials, such as microencapsulated flavoring agents, are set forth in Gutcho, Microcapsules and Microencapsulation Techniques (1976) and Gutcho, Microcapsules and Other Capsules Advances Since 1975 (1979). Exemplary types of microcapsules can have diameters of less than 100 microns, and often can have outer shells that are gelatin based, cyclodextrin based, or the like. Microcapsules have been commercially available, and exemplary types of microcapsule technologies are of that type set forth in Kondo, Microcapsule Processing and Technology (1979); Iwamoto et al., AAPS Pharm. Sci. Tech. 2002 3(3): article 25; and U.S. Pat. No. 3,550,598 to McGlumphy and U.S. Pat. No. 6,117,455 to Takada et al.

Flavor materials within the disclosed flavor delivery article 10 may also be provided in selectively crushable capsules 30 (see FIG. 2) so that the user may control if, when, and how much flavor is consumed from the product. Capsules 30 may be provided in all, some, or none of the filter element 26 or flavor carrier 12. Capsules may be provided one per segment. Alternatively, plural capsules may be provided within each flavor carrier 12, especially if only a single unitary flavor carrier fills the article 10, as shown in FIG. 1. The capsules may have the same additive stored therein or a variety of different additives in each capsule.

The wrapping element 16 can have indicia printed thereon. For example, a band 22 can indicate to a user the general location or position of the capsule 30 within the article 10. These indicia may help the user to locate the capsule so that it can be more easily ruptured by squeezing directly outside the position of the capsule. The indicia on the wrapping element may also indicate the nature of the payload carried by the capsule. For example, the indicia may indicate that the particular payload is a spearmint flavoring by having a particular color, shape, or design. By using indicia that is additive specific, a user may be able to know the location of the desired flavor to selectively allow for the consumption of specific flavorings at specific times when the product contains a plurality of different flavorings.

In some embodiments, the breakable capsules 30 are positioned within the filter material making up the carriers 12. In some embodiments, such breakable capsules can be positioned within a channel of the carriers. In some other embodiments, the capsules may be positioned between separate flavor carrier segments. The capsules may contain all of the flavor material for the product, or other components, such as the wrapping element, may be formed to include a separate amount of the flavor material. In some embodiments, the capsule can be simply imbedded in the carrier. In some embodiments, the filter material making up the carrier may include a compartment adapted for receiving the breakable capsule. Such a compartment may arise simply from the action of the capsule being physically inserted into the carrier, or may arise during the manufacturing thereof. Methods of manufacturing filter elements having a breakable capsule therein are described in U.S. Pat. No. 7,836,395 to Dube et al which is incorporated by reference herein.

If desired, the user may rupture the capsule 30 at any time during consumption the article 10. Breakage of the capsule acts to release the contents that are contained and sealed therein. Release of the contents of the capsule into the carrier element thus enables the user to achieve the intended benefit of certain of those contents. In a preferred embodiment, a portion of the payload (e.g., portions of the flavor material) that has been released into the carrier element is incorporated into each subsequent draw of air that is received through the article.

Application of tactile pressure to the capsule 30, for example by a squeezing action provided by the fingers of the user to the carrier 12, causes relevant regions of the carrier to deform and hence causes the capsule to rupture and release its payload. The rupture of the capsule can be discerned by an audible pop, snap, or a rapid decrease in the resistance to the pressure applied by the user. Rupture of the capsule causes contents of its payload to disperse throughout the carrier. Most preferably, the overall cylindrical shape of the carrier returns to essentially its original shape after the application of pressure has ceased.

In embodiments where a compartment is present to house the capsule, such compartment may have a generally circular and/or conical cross-sectional shape and have a diameter of about 3 mm to about 4 mm at its widest point. The walls of the compartment may be defined by compressible and deformable material (e.g., plasticized cellulose acetate), and the compartment may be manufactured so as to have a greater or smaller diameter.

The flavor carrier 12 may include one or more breakable capsules 30 having diameters of at least about 1 mm, typically at least about 2 mm, and often at least about 3 mm. Typically, the capsules have diameters that do not exceed about 6 mm, often do not exceed about 5 mm, and frequently do not exceed about 4.5 mm. Certain preferred capsules have diameters in the range of about 3 mm to about 4 mm in diameter, and certain highly preferred capsules are approximately 3.5 mm in diameter.

The capsules 30 can be generally spherical in shape and possess a rigid outer shell, such as a gelatin outer shell, that surrounds an internal payload. Suitable capsules are commercially available from Mane Aromatic Flavors, located in Nice, France as gelatin encapsulated mixtures of medium chain triglycerides and flavor agents. The designations of a number of flavor capsules that are available from Mane Aromatic Flavors are: Spearmint, E209123; Cinnamon, E0303392; Russian Tea, E0303386; Lemon, E127382; and Menthol, E127384. Such representative capsules have diameters of about 3.5 mm and about 4 mm.

The outer shell of the capsule 30 is preferably constructed of a food grade gelatin derived from bovine, piscine or porcine stock. A wide variety of gelatins may be used, and the selection of a gelatin for the capsule outer surface is considered a matter of design choice to those of ordinary skill in the art. See, Kirk-Othmer, *Encyclopedia of Chemical Technology*, ($4^{th}$ Ed.) 12, 406-416 (1994), which is incorporated herein by reference. The type of gelatin used for constructing the outer shell of the capsule provides that capsule with the capability of being exposed to triacetin (a common plasticizer used in cigarette filter manufacture) or 1,2 propylene glycol (a common tobacco casing component) for relatively long periods of time without experiencing undesirable interaction (e.g., dissolution of the gelatin therein). Because the gelatins used in the preferred embodiments may dissolve in water over extended periods of time, it is desirable to employ virtually anhydrous payloads (or payloads possessing very low amounts of water) with capsules having gelatin outer coatings.

The capsule payload can have a form that can vary; and typically, the payload has the form of a liquid, a gel, or a solid (e.g., a crystalline material or a dry powder).

In one embodiment, the payload is a mixture of a flavor material and a diluting agent. The preferred diluting agent is a triglyceride, such as a medium chain triglyceride, and more particularly a food grade mixture of medium chain triglycerides. See, for example, Radzuan et al., *Porim Bulletin,* 39, 33-38 (1999). Example flavorings of the payload have been discussed above.

The amount of flavor material and diluting agent within the capsule may vary. In some instances, the diluting agent may be eliminated altogether, and the entire payload can be composed of flavoring agent. Alternatively, the payload can be almost entirely comprised of diluting agent, and only contain a very small amount of relatively potent flavoring agent. In one embodiment using a capsule of, for example, approximately 3.5 mm in diameter, the weight of the liquid payload (e.g., flavoring agent and diluting agent) is preferably in the range of about 15 mg to about 25 mg, and more preferably in the range of about 20 mg to about 22 mg. The preferred composition of the mixture of flavoring and diluting agent is in the range of about 5 percent to about 25 percent flavoring, and more preferably in the range of about 10 to about 15 percent flavoring, by weight based on the total weight of the payload, with the balance being diluting agent.

In certain embodiments, one or more buffer substances are added to the flavor delivery article 10 for the purpose of soothing throat irritation that may develop during use of the product, and such buffer may be characterized as a throat irritation mitigant. The throat irritation mitigant can include any substance capable of mitigating or soothing irritation caused by the product, and expressly includes counter-irritants, anesthetics, and demulcents. Examples of throat irritation mitigants include sodium citrate, honey, ginger, pectin, capsaicin, camphor, dextromethorphan, echinacea, zinc gluconate, peppermint oil, spearmint oil, eucalyptus oil, glycerin, organic acids (e.g., citric acid, lactic acid, levulinic acid, or succinic acid), and combinations or extracts thereof (e.g., oleoresin ginger). Organic acids function by shifting the pH of the product into the acidic range, such as the pH range of about 3 to about 6.5. Typically, the organic acid is an organic acid containing at least one carboxylic acid group (e.g., carboxylic acids, dicarboxylic acids, and tricarboxylic acids). The amount of throat irritation mitigant used in the product can vary, but will be an amount sufficient to provide some degree of relief for throat irritation (e.g., a decrease in scratchy, lumpy sensations in the throat, a decrease in pain upon swallowing, a decrease in hoarseness while speaking, or a decrease in coughing). In exemplary embodiments, the throat irritation mitigant is present in an amount of at least about 1 weight percent, or at least about 2 weight percent, or at least about 3 weight percent (e.g., about 1 to about 10 weight percent).

Many modifications and other embodiments of the invention will come to mind to one skilled in the art to which this invention pertains having the benefit of the teachings presented in the foregoing description. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

The invention claimed is:

1. A flavor delivery article comprising:

a substantially rod-shaped carrier element formed of a highly porous fiber, a tow, a film, pellets, threads, non-woven rayon, non-woven polyester, a polyolefin which is not polypropylene tow, or combinations thereof;

a wrapping element surrounding and adhesively secured to at least a portion of the carrier element, wherein the wrapping element comprises a first tipping material and a second tipping material, and a first flavor material comprising at least a tobacco extract included in the carrier element, and a second flavor material that is different from the first flavor material, the second flavor material included in either or both of the first and second tipping materials, the second flavor material in encapsulated form, and wherein the flavor delivery article is adapted for separate delivery of the first flavor material and the second flavor material to the mouth of a user under mouth conditions in the absence of combustion or other external heating.

2. The article according to claim 1, wherein the carrier element further comprises gathered cellulose acetate tow, gathered cellulose acetate web, polypropylene tow, gathered paper, or combinations thereof.

3. The article according to claim 1, wherein the carrier element comprises a plurality of segments.

4. The article according to claim 3, wherein first flavor material is present in one of the segments.

5. The article according to claim 3, wherein flavor material is in two or more segments.

6. The article according to claim 3, wherein a first segment surrounds a second segment.

7. The article according to claim 1, wherein the first flavor material and the second flavor material separately comprise at least one of sweeteners, vanilla, coffee, tea, chocolate, cream, mint, spearmint, menthol, peppermint, wintergreen, lavender, cardamom, nutmeg, cinnamon, clove, cascarilla, sandalwood, honey, maple, jasmine, ginger, anise, sage, licorice, lemon, orange, apple, peach, lime, cherry, and strawberry.

8. The article according to claim 1, wherein the mouth condition is moisture, and the delivery article is adapted for flavor delivery through contact with moisture in the mouth.

9. The article according to claim 1, wherein the mouth condition is heat, and the delivery article is adapted for flavor delivery through body heat provided in the mouth.

10. The article according to claim 1, wherein the mouth condition is chewing, and the delivery article is adapted for flavor delivery when subject to mechanical force provided by teeth.

11. The article according to claim 1, wherein the flavor delivery article has a first end and a second end, and wherein subjecting the first end to mouth conditions releases one of the first flavor material and the second flavor material, and subjecting the second end to mouth conditions releases the other of the first flavor material and the second flavor material.

12. The article according to claim 1, wherein the carrier is porous, and one or both of the first flavor material and the second flavor material is released from the delivery article by drawing air through the carrier.

13. The article according to claim 1, wherein the second flavor material is microencapsulated.

14. The article according to claim 1, wherein at least one of the first flavor material and the second flavor material is contained within a breakable capsule.

15. The article according to claim 1, further comprising a throat irritation mitigant.

16. The article according to claim 15, wherein the throat irritation mitigant is levulinic acid.

17. The article according to claim 1, wherein the first tipping material is an inner layer, and the second tipping material is an outer layer.

18. The article according to claim 17, wherein the first flavor material is absorbed in the carrier element, and the second flavor material is incorporated between the inner and outer layer.

19. The article according to claim 18, wherein the outer layer is adapted to substantially prevent the second flavor material from escaping prior to use of the article.

20. The article according to claim 19, wherein the outer layer is removable.

* * * * *